US005891594A

United States Patent [19]

Yuh et al.

[11] Patent Number: 5,891,594

[45] Date of Patent: Apr. 6, 1999

[54] PROCESS FOR PREPARING ELECTROPHOTOGRAPHIC IMAGING MEMBER WITH PERYLENE-CONTAINING CHARGE-GENERATING MATERIAL AND N-BUTYLACETATE

[75] Inventors: Huoy-Jen Yuh, Pittsford; John S. Chambers, Rochester, both of N.Y.

[73] Assignee: Xerox Corporation, Stamford, Conn.

[21] Appl. No.: 782,238

[22] Filed: Jan. 13, 1997

[51] Int. Cl.[6] ..... G03G 5/16

[52] U.S. Cl. ..... 430/71; 430/78; 430/134

[58] Field of Search ..... 430/71, 78, 134, 430/58

[56] References Cited

U.S. PATENT DOCUMENTS

| | | |
|---|---|---|
| 3,904,407 | 9/1975 | Regensburger et al. . |
| 4,587,189 | 5/1986 | Hor et al. . |
| 4,855,203 | 8/1989 | Badesha et al. . |
| 5,225,307 | 7/1993 | Hor et al. . |
| 5,350,654 | 9/1994 | Pai et al. . |
| 5,395,722 | 3/1995 | Nukada et al. . |
| 5,521,047 | 5/1996 | Yuh et al. . |
| 5,547,790 | 8/1996 | Umeda et al. . |

OTHER PUBLICATIONS

US Statutory Invention Registration H1474 to Martin et al., Aug 1995.

*Primary Examiner*—Christopher D. Rodee
*Attorney, Agent, or Firm*—Oliff & Berridge, PLC

[57] ABSTRACT

An electrophotographic imaging member having a perylene-containing charge generating layer is prepared by forming a dispersion of a perylene-containing charge generating material and a solvent including n-butylacetate and applying the dispersion to an electrophotographic imaging member layer by solution coating. The solvent may include n-butylacetate and a second solvent having a boiling point lower than that of n-butylacetate.

16 Claims, No Drawings

PROCESS FOR PREPARING ELECTROPHOTOGRAPHIC IMAGING MEMBER WITH PERYLENE-CONTAINING CHARGE-GENERATING MATERIAL AND N-BUTYLACETATE

BACKGROUND OF THE INVENTION

This invention relates in general to electrophotography and, in particular, to a process for preparing electrophotographic imaging members containing a perylene-containing charge generating layer.

In electrophotography, the surface of an electrophotographic plate, drum, belt or the like (imaging member) containing a photoconductive insulating layer on a conductive layer is first uniformly electrostatically charged. The imaging member is then exposed to a pattern of activating electromagnetic radiation such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly to a print substrate, such as paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material.

In addition, the imaging member may be layered. Current layered organic imaging members have at least a substrate layer and two active layers: (1) a charge generating layer containing a light-absorbing material, and (2) a charge transport layer containing electron donor molecules.

The substrate layer may be formed from a conductive material. In addition, a conductive layer can be formed on a nonconductive substrate.

The charge generating layer is capable of photogenerating charge and injecting the photogenerated charge into the charge transport layer. U.S. Pat. No. 4,855,203 to Miyaka teaches charge generating layers comprising a resin dispersed pigment. Suitable pigments include photoconductive zinc oxide or cadmium sulfide and organic pigments such as phthalocyanine type pigment, a polycyclic quinone type pigment, a perylene pigment, an azo type pigment and a quinacridone type pigment. Imaging members with perylene charge generating pigments, particularly benzimidazole perylene, show superior performance with extended life.

In the charge transport layer, the electron donor molecules may be in a polymer binder. In this case, the electron donor molecules provide hole or charge transport properties, while the electrically inactive polymer binder provides mechanical properties. Alternatively, the charge transport layer can be made from a charge transporting polymer such as poly(N-vinylcarbazole), polysilylene or polyether carbonate, wherein the charge transport properties are incorporated into the mechanically strong polymer.

Imaging members may also include a charge blocking layer and/or an adhesive layer between the charge generating and the conductive layer. In addition, imaging members may contain protective overcoatings. Further, imaging members may include layers to provide special functions such as incoherent reflection of laser light, dot patterns and/or pictorial imaging or subbing layers to provide chemical sealing and/or a smooth coating surface.

Suitable coating methods used for applying the various layers in electrophotographic imaging members include dip coating, roll coating, Meyer bar coating, bead coating, curtain flow coating and vacuum deposition. Solution coating is a preferred approach because it is more economical than vacuum coating and can be used to deposit a seamless layer.

U.S. Pat. No. 4,855,203 to Miyaka teaches applying charge generating layers from coating solutions comprising a resin dispersed pigment. Miyaka discloses suitable organic solvents for preparing a coating solution of the pigments as including alcohols such as methanol, ethanol and isopropanol; ketones such as acetone, methylethyl ketone and cyclohexanone; amides such as N,N-dimethyl formamide and N,N-dimethyl acetamide; sulfoxides such as dimethyl sulfoxide; ethers such as tetrahydrofuran, dioxane and ethylene glycol monomethyl ether; esters such as methyl acetate and ethyl acetate; aliphatic halogen hydrocarbons such as chloroform, methylene chloride, dichloroethylene, carbon tetrachloride and trichloroethylene; or aromatic compounds such as benzene, toluene, xylene, ligroin, monochlorobenzene and dichlorobenzene.

U.S. Pat. No. 3,904,407 to Regensburger et al. teaches applying perylene containing charge generating layers by a vacuum coating process. Vacuum coated charge generating layers containing perylenes show a high photosensitivity. However, vacuum coating is expensive.

Solution coating is a more economical and convenient method of applying charge generating layers. However, perylene pigments are difficult to disperse and unstable dispersions are encountered with coating perylene pigment charge generating layers from solution. Unstable dispersions cause pigment flocculating and settling that leads to coating quality problems. In addition, unstable dispersions are difficult to process, especially in a dip coating process. Further, dip coated perylene containing charge generating layers show a substantial depreciation in photosensitivity as compared to vacuum coated layers.

U.S. Pat. No. 5,521,047 to Yuh et al. is directed to a process for preparing an electrophotographic imaging member having a perylene-containing charge generating layer from solution. The process comprises forming a dispersion of a perylene pigment and a polyvinylbutyryl binder in an acetate solvent and applying the dispersion to an electrophotographic imaging member layer by solution coating.

Yuh et al. teaches that perylenes form stable dispersions in acetate solvents for the purposes of application by solvent coating such as dip coating. In addition, Yuh et al. teaches that photoreceptors that include charge generating layers containing perylene charge generating materials applied from dispersions in acetate solvents display increased sensitivity.

SUMMARY OF THE INVENTION

The present invention is directed to a process for preparing an electrophotographic imaging member having a perylene-containing charge generating layer. The process comprises forming a dispersion of a perylene pigment in a solvent comprising n-butylacetate and applying the dispersion to an electrophotographic imaging member by solution coating. The solvent may comprise n-butylacetate and a second solvent having a lower boiling point than n-butylacetate. The present invention is also directed to a dispersion for forming a charge-generating layer by the above process.

N-butylacetate forms a stable dispersion of the perylene-containing charge generating material and a film-forming binder. Applying the perylene-containing charge generating material in n-butylacetate results in a charge generating layer having good sensitivity. In addition, the viscosity of n-butylacetate provides for efficient milling. Further, by using n-butylacetate and a second solvent having a lower boiling than n-butylacetate, the layer may be formed with decreased flash off time, while maintaining a stable dispersion, good sensitivity and efficient milling.

DETAILED DESCRIPTION OF THE PREFERRED EMBODIMENTS

The present invention relates to a method of forming a charge generating layer containing perylene pigments by a solution coating process. In the present invention, any suitable perylene-containing charge generating material may be applied to the substrate or other layer of the photoreceptor. In the present invention, the perylene pigment is dispersed in a solvent for application of the charge generating layer. Preferably, the perylene pigment is dispersed in a film-forming binder and the resulting dispersion is dissolved in the solvent.

The charge generating dispersion may be applied to the substrate or other layer of the photoreceptor by any known solution coating technique. Solution coating techniques that may be used include, but are not limited to, dip coating, spray coating, blade/knife coating, roll coating and curtain flow coating. In the present invention, dip coating is a preferred technique for applying the charge generating layer.

Examples of perylene pigments that can be used in the present invention include, but are not limited to, those disclosed in U.S. Pat. No. 4,587,189 to Hor et al., the disclosure of which is incorporated herein by reference. In a preferred embodiment of the present invention, the pigment is a benzimidazole perylene charge generating material.

Any of the known benzimidazole perylene charge generating materials suitable for use in photoreceptors may similarly be used in the photoreceptors of the present invention. For example, suitable benzimidazole perylene charge generating materials are disclosed in U.S. Pat. Nos. 4,587,189 and 5,225,307, the disclosures of which are incorporated herein by reference. Benzimidazole perylenes include, but are not limited to, the following structures:

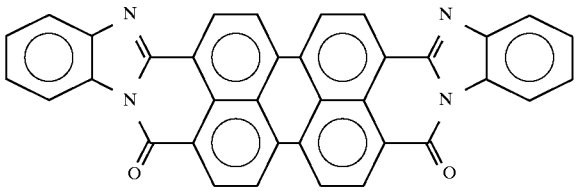

and

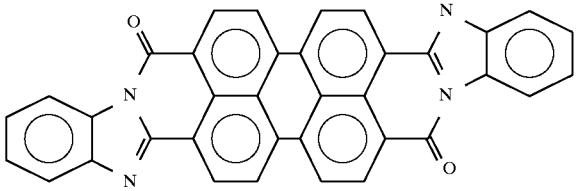

In addition, cis- and trans-isomers of benzimidazole perylene, having the formulas bisbenzimidazo-(2,1-a:1',2'-b')anthra(2,1,9-def:6,5,10-d'e'f')-diisoquinoline-6,11-dione and bisbenzimidazo-(2,1-a:2',1'-a')anthra(2,1,9-def:6,5,10-d'e'f')-diisoquinoline-10,21-dione are suitable for use in the present invention.

Perylene pigments having any suitable particle size may be used. Preferably, following processing of the benzimidazole perylene as described below, the resultant particles have an average particle size (average diameter) of from about 0.03 to about 0.5 μm. Preferably, the particles have an average particle size of from about 0.05 to about 0.35 μm, and more preferably from about 0.05 to about 0.25 μm.

Perylene pigments having suitable particle sizes may be formed by mechanically grinding or milling the perylene pigments. Mechanically grinding the perylene pigment may be done before the pigment is in solution and/or after the pigment has been added to a solvent.

In embodiments of the present invention, the bulk perylene pigment is dispersion milled for a time period of from about 2 to about 100 hours. The milling time will depend, of course, upon the desired electrical response characteristics of the photoreceptor into which the particulate material is to be incorporated. Furthermore, the processing time will depend upon such other factors as the type of milling apparatus used, the grinding media used in the milling apparatus, the physical characteristics (such as size) of the perylene starting material, the total quantity of the dispersion to be milled, and the like. Preferably, the milling time in embodiments of the present invention is from about 3 to about 75 hours, and more preferably from about 4 to about 65 hours. However, milling times outside of these ranges may suitably be used, and one skilled in the art will be able to adjust the milling time accordingly.

The dispersion milling may be conducted using any suitable milling equipment. For example, the milling may be conducted in such equipment as a jar mill, a ball mill, an attritor, a sand mill, a paint shaker, a dynomill, or a drum tumbler. Such equipment should also include a suitable grinding media of, for example, round, spherical or cylindrical grinding beads of steel balls, ceramic cylinders, glass balls, round agates or stones.

Alternatively, any other of the known milling operations and equipment may be used in embodiments of the present invention. The appropriate milling time range will vary depending upon the type of milling operation used, the milling media used in the equipment, and similar factors. The appropriate milling time to provide the desired electrical response characteristics are thus related to the specific milling operation, and can be selected accordingly.

Acetate solvents form stable dispersions of a perylene pigment and a film-forming binder. In addition, charge generating layers formed by solution coating perylene pigments in acetate solvents achieve good sensitivity. In particular, n-butylacetate has been shown to both stabilize the dispersion and achieve good sensitivity. Further, the viscosity of n-butylacetate provides for efficient milling. In particular, with n- butylacetate as the dispersion solvent, the time required to reach the desired particle size is shorter than with other alkyl acetate solvents.

N-butylacetate has a boiling point of approximately 126° C. As a result, the time required to flash off the solvent after coating can be between three and ten minutes. Thus, in an embodiment of the present invention, the perylene pigment is dispersed in n-butylacetate and a second solvent having a lower boiling point than n-butylacetate. By adding a second solvent having a lower boiling point than n-butylacetate, the flash-off time necessary to prepare the charge generating layer can be reduced without adversely affecting the high dispersion stability provided by the n-butylacetate.

It has been found that a second solvent can be added without significantly affecting the dispersion quality. In particular, the efficient milling associated with n-butylacetate can be maintained by milling the perylene pigment in n-butylacetate before the second solvent is added. Preferably, a solution comprising pigment, film-forming binder and n-butylacetate is milled before the second solvent is added.

In this embodiment of the present invention, the perylene pigment and optionally the film-forming binder are dispersed in n-butylacetate at a high solids content. The dispersion preferably contains from 5 to 20% by weight solids, and more preferably from 8 to 14% by weight solids. The dispersion is then milled to achieve a suitable particle size and/or to disperse the solids in the n-butylacetate.

Next, a second solvent having a lower boiling point than n-butylacetate is added to the dispersion to achieve a dispersion suitable for solution coating. The dispersion preferably contains from 2 to 10% by weight solids, and more preferably from 3 to 8% by weight solids. After the second solvent is added, the dispersion may be further mixed, if necessary, to disperse the pigment in the solvent system.

The second solvent can be any solvent suitable for solution coating perylene-containing charge generating layers, as long as the solvent has a lower boiling point than n-butylacetate. The second solvent is generally mixable with n-butylacetate, is more volatile than n-butylacetate and can dissolve the film-forming binder used for dispersing the perylene pigment.

The second solvent may be an acetate solvent. Preferably, the acetate solvent is a lower alkylacetate. More preferably, the alkyl has 1 to 4 carbon atoms. Examples of acetate solvents having a lower boiling point than n-butylacetate include, but are not limited to, methylacetate, ethylacetate, isopropylacetate, n-propylacetate, sec-butylacetate and tert-butylacetate. A preferred acetate solvent is ethylacetate.

In addition, the second solvent may be a non-acetate solvent having a lower boiling point than n-butylacetate. Solvents that may be used include, but are not limited to, alcohols, e.g., methanol, ethanol, and isopropanol; ketones, e.g., acetone and methylethylketone; ethers, e.g., tetrahydrofuran and dioxane; halogenated aliphatic hydrocarbons, e.g., chloroform, methylene chloride, dichloroethylene, 1,1,1-trichloroethane, 1,1,2-trichloroethane, and trichloroethylene; mixtures thereof and the like. Tetrahydrofuran and alcohol solvents having a boiling point lower than n-butylacetate are preferred.

In the present invention, any suitable polymeric film-forming binder material may be employed as a matrix in the charge generating layer. The binder preferably adheres well to the substrate or other underlying layer and dissolves in the solvent system. Examples of materials useful as the film-forming binder include, but are not limited to, phenoxy resin, polyvinylformal, polyvinylacetals, polyvinylbutyral, polyester and copolymers of the above-mentioned polymers. Polyvinylbutyral is a preferred binder polymer.

The concentration of charge generating material in the layer may generally vary from about 5 to 100 percent by weight of the layer. A photogenerating layer comprising 100 percent charge generating material may be prepared by coating a binderless dispersion of the charge generating material onto the substrate or other layer of the photoreceptor. Benzimidazole perylene charge generating materials are especially suited for application as a binderless material. When the photogenerating material is present in a binder material, the binder preferably contains from about 20 to about 95 percent by weight of the photogenerating material, and more preferably from about 40 to about 80 percent by weight of the photogenerating material.

Exemplary charge generating layer thicknesses formed according to the present invention include, but are not limited to, thicknesses ranging from about 0.05 micrometer to about 5.0 micrometers, and preferably from about 0.15 micrometer to about 3 micrometers. Charge generating layer thickness generally depends on film-forming binder content. Higher binder content generally results in thicker layers for photogeneration. Thicknesses outside the above exemplary ranges are also within the scope of the invention.

The electrophotographic imaging member formed by the process of the present invention generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the disclosure of which is incorporated herein by reference.

In an embodiment of the present invention, the electrophotographic imaging member formed by the process of the present invention comprises a perylene-containing charge generating layer, a charge transport layer and an interface region between the charge generating layer and the charge transport layer. The interface region may contain a mixture of charge transport material and charge generating material. In a further embodiment of the invention, the interface region is formed by applying a charge transport material to an underlying layer of perylene-containing charge generating material prior to drying or curing the underlying layer, as disclosed in U.S. Pat. No. 5,521,047 to Yuh et al.

In an additional embodiment of the present invention, a electrophotographic imaging member is formed having one or more additional layers, such as a substrate, a conductive layer, a blocking layer, an adhesive layer and/or a protective overcoating layer. The layers may be prepared and applied using conventional materials and methods.

The invention will be further illustrated in the following examples, it being understood that the examples are illustrative only and that the invention is not limited to the materials, conditions, process parameters and the like recited therein.

EXAMPLE 1

A nylon charge blocking layer is fabricated from an 8% by weight solution of nylon in a butanol, methanol and water mixture. The butanol, methanol and water mixture percentages are 55, 36 and 9% by weight, respectively. The charge blocking layer is dip coated onto an aluminum drum substrate and is dried at a temperature of about 105° C. for about 5 minutes. The dried nylon containing blocking layer has a thickness of about 1.5 microns.

To form a charge generating layer, a dispersion is prepared by milling a solution containing 8.16% by weight benzimidazole perylene, 3.84% by weight polyvinylbutyral B79 (Mansanto Chem. Co.), and 88% by weight n-butylacetate. The solution has 12% by weight solids content.

The milling procedure is carried out in a KDL type dynomill with a nylon lined grinding chamber that has been charged with 0.4–0.6 mm zirconium oxide beads. The beads occupy 50% of the nylon grinding chamber volume. The chamber is cooled with water to keep the dispersion temperature between 30° and 40° C. The dispersion is prepared first by dissolving the B79 into n-butylacetate. The perylene pigment is then slowly added into the polymeric solution. The perylene dispersion is then stirred until the dispersion is homogenous. The dispersion is put into a closed container and circulated through a dynomill with a pump for milling. The dynomilling time is dependent on the volume of solution being processed, solution flow rate through the grinding chamber, grinding speed of the chamber, and initial benzimidazole perylene pigment particle size. The dispersion is deemed acceptable for let down and coating when the particle size of the n-butylacetate dispersion as measured by light scattering is between 160–190 nm. For a six liter dispersion, with a flow rate of 300 ml/minute and grinding speed of 2500 rpm, 36 hours milling time is required.

When the dispersion has reached the desired particle size, it is diluted with n-butylacetate to 5% by weight solids content. The particle size of the 5% solid dispersion is measured again by light scattering. The measurement results are reported in Table 1. The dispersion is then dip coated onto the charge blocking layer and allowed to dry in ambient air (temperature=25° C. and relative humidity=25%). The dried charge generating layer has a thickness of about 0.5 micron.

A charge transport layer is prepared from a 20% by weight solids solution of N,N'-diphenyl-N,N'-bis-(3-methylphenyl)-(1,1-biphenyl)-4,4'-diamine and PCZ400 (from Mitsubishi Chem. Co., Japan) in monochlorobenzene. The ratio of the diamine to the PCZ400 is 40/60% by weight. The charge transport layer is dip coated onto the charge generating layer and is dried at about 130° C. for about 60 minutes. The dried charge transport layer has a thickness of about 20 microns.

EXAMPLE 2

A nylon charge blocking layer is fabricated as in Example 1. To form a charge generating layer, a dispersion is prepared by milling a solution containing 8.16% by weight benzimidazole perylene, 3.84% by weight polyvinylbutyral B79, and 88% by weight n-butylacetate. The dynomilling procedure is carried out as in Example 1. When the dispersion has reached the desired particle size, the dispersion is diluted with a mixture of n-butylacetate and ethylacetate (1/1 by weight) to form a dispersion having a 5% by weight solids content. The final relative weight ratio of the n-butylacetate to the ethylacetate in the 5% solids dispersion is 70:30. The particle size measurement results are reported in Table 1. The dispersion is then dip coated onto the charge blocking layer and dried as in Example 1. The dried charge generating layer has a thickness of about 0.5 micron. A charge transport layer is then prepared thereon as in Example 1.

EXAMPLE 3

A nylon charge blocking layer is fabricated as in Example 1. To form a charge generating layer, a dispersion is prepared by milling a solution containing 8.16% by weight benzimidazole perylene, 3.84% by weight polyvinylbutyral B79, and 88% by weight n-butylacetate. The dynomilling procedure is carried out as in Example 1. When the dispersion has reached the desired particle size, the dispersion is then diluted with a mixture of n-butylacetate and tetrahydrofuran (1/1 by weight) to form a dispersion having a 5% by weight solids content. The final relative weight ratio of n-butylacetate to tetrahydrofuran in the 5% solids dispersion is 70:30. The particle size measurement results are reported in Table 1. The dispersion is then dip coated onto the charge blocking layer and dried as in Example 1. The dried charge generating layer has a thickness of about 0.5 micron. A charge transport layer is then prepared thereon as in Example 1.

TABLE 1

Particle Size Data

| | Average Particle Size (nm) | Half Width (particle size distribution) |
|---|---|---|
| Example 1 n-butylacetate | 154 | 31 |
| Example 2 n-butylacetate and ethyl acetate | 136 | 50 |
| Example 3 n-butylacetate and tetrahydrofuran | 136 | 34 |

EXAMPLE 4

The photoreceptor devices prepared from Examples 1, 2 and 3 are tested in a cyclic scanner. The drums are rotated at a constant surface speed of 5.66 cm per second. A direct current wire scrotron, a narrow wavelength band exposure light, an erase light and electrometer probes are mounted around the periphery of the mounted drums. The sample charging time is 177 milliseconds. The exposure light has an output wavelength of 670 nm and the erase light has an output wavelength of 650 to 720 nm.

The test samples are first rested in the dark for 10 minutes, then each sample is negatively charged in the dark to a potential of 600 Volts. The drum is then discharged by exposing the photoreceptor to the exposure light. The discharged surface potential is measured immediately after the exposure. The procedure is repeated with different exposure light intensities to obtain the photo induced discharge characteristic of each sample device. The sensitivities (dv/dx, X(100V)(ergs/cm$^2$), calculated from the rate of surface potential change as a function of exposure energy, and the required exposure light energy to discharge the surface potential to 100 Volts are listed in Table 2. As seen in Tables 1 and 2, the second solvents for diluting do not affect the dispersion quality and the photoreceptor photo induced discharge characteristics.

TABLE 2

Electrical Data

| | Sensitivity dv/dx | X (100V) (ergs/cm$^2$) |
|---|---|---|
| Example 1 n-butylacetate | 83 | 10.1 |
| Example 2 n-butylacetate and ethyl acetate | 91 | 9.0 |
| Example 3 n-butylacetate and tetrahydrofuran | 88 | 9.2 |

While the invention has been described with reference to particular preferred embodiments, the invention is not limited to the specific examples given and other embodiments and modifications can be made by those of ordinary skill in the art without departing from the spirit and scope of the invention and claims.

What is claimed is:

1. A process for preparing an electrophotographic imaging member having a perylene-containing charge generating layer, comprising:

dispersing a perylene-containing charge generating material in a solvent comprising n-butylacetate and a second solvent having a lower boiling point than n-butylacetate, wherein said second solvent is an acetate or tetrahydrofuran, and applying the dispersion to form said charge generating layer on a substrate or underlayer of the imaging member.

2. The process according to claim 1, wherein said second solvent is an acetate solvent.

3. The process according to claim 2, wherein said second solvent is ethylacetate.

4. The process according to claim 2, wherein the perylene-containing charge generating material is milled in n-butylacetate before the second solvent is added.

5. The process according to claim 1, wherein said perylene-containing charge generating material is dispersed with a film-forming binder in said solvent.

6. The process according to claim 5, wherein said film-forming binder is polyvinylbutyral.

7. The process according to claim 1, wherein said perylene-containing charge generating material is a benzimidazole perylene charge generating material.

8. The process according to claim 1, wherein said perylene-containing charge generating material is benzimidazole perylene.

9. The process according to claim 1, wherein the second solvent is tetrahydrofuran.

10. A dispersion for formimg a charge generating layer comprising a perylene-containing charge generating material, n-butylacetate and a solvent having a lower boiling point than n-butylacetate, wherein said solvent is an acetate or tetrahydrofuran.

11. The dispersion according to claim 10, wherein said solvent is an acetate solvent.

12. The dispersion according to claim 11, wherein said solvent is ethylacetate.

13. The dispersion according to claim 10, further comprising a film-forming binder.

14. The dispersion according to claim 13, wherein said film-forming binder is polyvinylbutyral.

15. The dispersion according to claim 10, wherein said perylene-containing charge generating material is a benzimidazole perylene charge generating material.

16. The dispersion according to claim 10, wherein the solvent is tetrahydrofuran.

* * * * *